United States Patent [19]

Nilssen

[11] Patent Number: 4,591,764

[45] Date of Patent: May 27, 1986

[54] PLUG-IN AUXILIARY TRACKS FOR TRACK LIGHTING SYSTEMS

[76] Inventor: Ole K. Nilssen, Caesar Dr., R.R. 5, Barrington, Ill. 60010

[21] Appl. No.: 580,649

[22] Filed: Feb. 16, 1984

[51] Int. Cl.[4] ..... H05B 37/00; H01R 9/00

[52] U.S. Cl. ..... 315/312; 315/324; 315/172; 315/174; 315/210; 339/20; 362/404

[58] Field of Search ..... 315/312, 324, 210, 172, 315/174; 339/20, 21 R; 362/404, 147, 226, 227, 217

[56] References Cited

U.S. PATENT DOCUMENTS

| | | | |
|---|---|---|---|
| 3,980,368 | 9/1976 | Fremont | 339/21 R |
| 4,190,309 | 2/1980 | Glass | 339/21 R |
| 4,203,053 | 5/1980 | Shepard | 315/312 X |
| 4,207,498 | 6/1980 | Spira et al. | 315/210 X |

FOREIGN PATENT DOCUMENTS

| | | | |
|---|---|---|---|
| 2120024A | 11/1983 | United Kingdom | 339/20 |

*Primary Examiner*—David K. Moore
*Assistant Examiner*—Vincent DeLuca

[57] ABSTRACT

A relatively light-weight auxiliary power track is adapted to be plugged into and supported by a regular power track in an otherwise ordinary 120 Volt/60 Hz track lighting system. A compact frequency converter is operative to provide 120 Volt/30 kHz high-frequency voltage on the auxiliary track, and light-weight low-voltage Halogen lighting units are provided for plug-in use therein. Each of these lighting units comprises a high-frequency light-weight voltage step-down transformer.

14 Claims, 10 Drawing Figures

CTC
CPT
CSM
STC

CPT
CTC
FC
SPT
STC
SSM

FC
SPT
SSM
CPT
STLUm
SSM
CCFM
SPT
CCFM
CL
STLU1
CSM
CPT

CTC
CPT
SPTa
STCa
SSMa

CPT
CTC
STCa
SSMa
FCa
SPTa
CCFMa

PLUG-IN AUXILIARY TRACKS FOR TRACK LIGHTING SYSTEMS

BACKGROUND OF THE INVENTION

1. Field of the Invention

The present invention relates to track lighting systems, particularly of a kind having plug-in auxiliary power tracks.

2. Description of Prior Art

Track lighting systems are being manufactured and marketed by several companies. One such company is Halo Lighting Division of McGraw-Edison Company, Elk Grove Village, Ill. 60007; whose track lighting systems and products are described in their Catalog No. A8100.

Conventional track lighting systems are designed to operate from an ordinary utility power line and to have regular 120 Volt/60 Hz voltage on the track conductors. A track may have one or more pairs of such track conductors. The lighting units plugged into the track must be able to operate directly from this 120 Volt/60 Hz voltage.

Low voltage incandescent lamps, particularly Halogen lamps, have proven to be particularly attractive for track lighting purposes, and are being used to a growing degree. However, these low-voltage/Halogen lamps are designed to operate at a voltage of 12 Volt or less, and therefore have to be powered by way of voltage step-down transformation means. Thus, at present, whenever low-voltage/Halogen lamps are being used in track lighting systems, each such low-voltage/Halogen lamp has to be powered by way of such a voltage step-down transformation means; which implies that each lighting unit has to contain such a voltage step-down transformation means—a practice that results in costly, large and relatively heavy track lighting units.

Against this background, it appears useful to provide for a track lighting system a special auxiliary power track; a special power track that can readily be plugged into and supported by the existing power track and that provides on its track conductors a voltage that permits the use therewith of a number of low-voltage/Halogen lamps without the need for using with each individual lamp a voltage transformation means operative to convert the 120 Volt/60 Hz voltage to the requisite low lamp operating voltage.

SUMMARY OF THE INVENTION

1. Objects of the Invention

A first object of the present invention is that of providing for a more cost-effective means to permit the use of low-voltage incandescent lamps with conventional track lighting systems.

A second object is that of providing an auxiliary high-frequency power track adapted to be plugged into and held by an ordinary track lighting system and to permit the cost-effective use therewith of low-voltage Halogen lamps.

These as well as other objects, features and advantages of the present invention will become apparent from the following description and claims.

2. Brief Description

In its preferred embodiment, the present invention may be considered to consist of the following key component parts:

(a) an auxiliary high-frequency power track adapted to be plugged into and supported by one of the regular 120 Volt/60 Hz power tracks of an ordinary track lighting system, and operable to receive, hold and power a plurality of special high-frequency Halogen lighting units, this auxiliary high-frequency power track having built-in frequency converting means operable to be powered from the 120 Volt/60 Hz voltage on the regular power track and to provide a 120 Volt/30 Hz high-frequency voltage on the track conductors of the auxiliary high-frequency power track; and (b) a number of special high-frequency Halogen lighting units, each such high-frequency lighting unit comprising a 12 Volt Halogen lamp and a high-frequency voltage step-down transformer operative to connect between the Halogen lamp and the 120 Volt/30 kHz high-frequency voltage on the auxiliary high-frequency power track and to convert this 120 Volt high-frequency voltage to a 12 Volt high-frequency voltage suitable for powering the Halogen lamp.

Due to the high-frequency operation, the size and weight of the voltage step-down transformer used with each high-frequency Halogen lighting units is very small, thereby permitting the size and weight of such a high-frequency Halogen lighting unit to be very modest.

The frequency converting means is also very compact and light-of-weight, thereby permitting it conveniently to be an integral built-in part of the auxiliary power track.

BRIEF DESCRIPTION OF THE DRAWINGS

FIGS. 4*a* and 4*b* illustrate the mechanical layout of the preferred embodiment.

FIG. 5 illustrates an installation of a track lighting system according to the preferred embodiment.

FIGS. 6*a* and 6*b* illustrate an alternative mechanical layout of subject invention.

DESCRIPTION OF TYPICAL PRIOR ART

Figure 1:
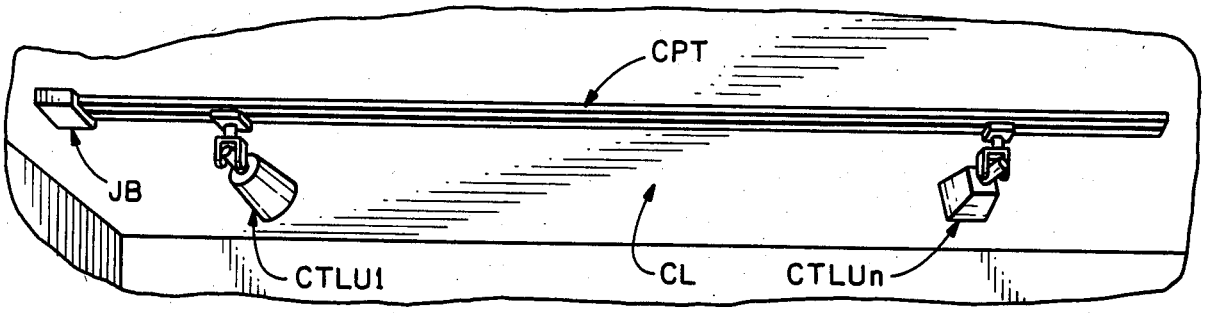
FIG. 1 illustrates a typical installation of a prior art conventional track lighting system.

In FIG. 1, JB represents an electrical junction box in a ceiling CL. Fastened to and extending along the ceiling from this junction box is a conventional power track CPT, which comprises conventional slot means CSM, by way of which conventional track lighting units CTLU1—CTLUn are removably fastened to and connected with the power track.

Figure 2:
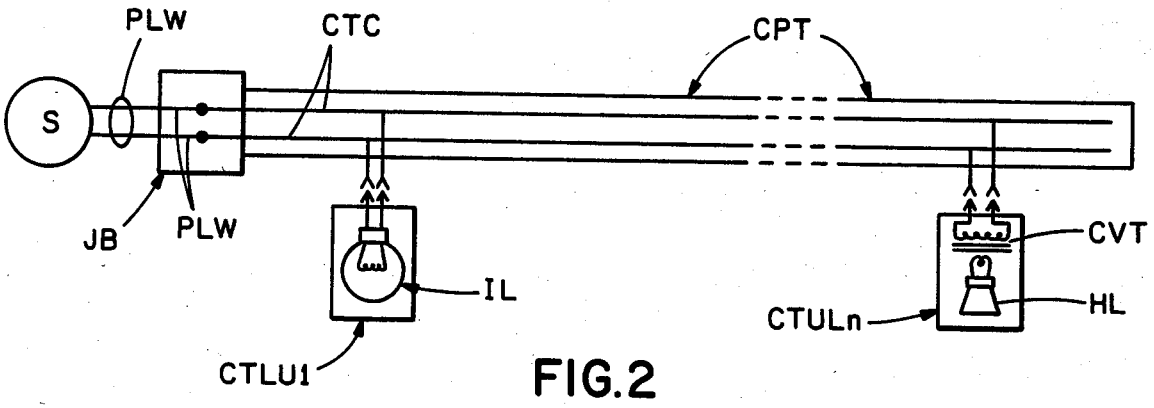
FIG. 2 diagrammically illustrates the electrical arrangement of this prior art conventional track lighting system.

In FIG. 2, a source S provides a 120 Volt/60 Hz voltage across a pair of power line wires PLW, which power line wires enter junction box JB. A pair of conventional track conductors CTC in the conventional power track CPT connects directly with these power line wires, which track conductors extend for the length of the track. To the track conductors, at different points along the track, are connected the conventional track lighting units CTLU1—CTLUn.

Track lighting unit CTLU1 comprises an ordinary 120 Volt incandescent lamp IL, the electrical terminals of which are disconnectably connected directly across the track conductors.

Track lighting unit CTLUn comprises a 12 Volt/50 Watt Halogen lamp HL, the electrical terminals of which are connected with the secondary winding of a conventional 60 Hz step-down voltage transformer CVT. The primary winding of this transformer is disconnectably connected directly across the track conductors.

The operation of the prior-art conventional track lighting system illustrated by FIG. 1 and FIG. 2 is well known and need not be further explained here.

DESCRIPTION OF THE PREFERRED EMBODIMENT

Figure 3:
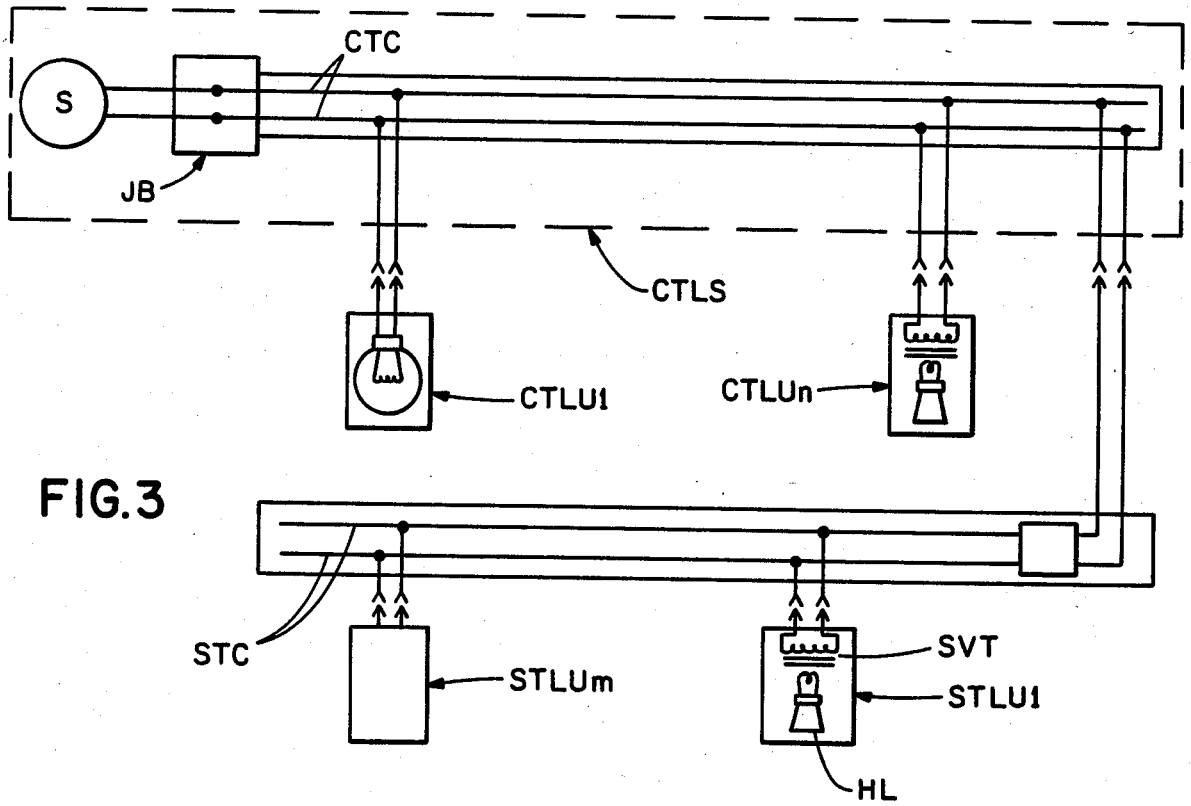
FIG. 3 diagrammatically illustrates the electrical circuit arrangement of the preferred embodiment of subject invention.

FIG. 3 provides a schematic illustration of the electrical arrangement of a track lighting system according to the preferred embodiment of the present invention.

The system consists of a conventional track lighting system CTLS, in accordance with FIG. 2, to which is disconnectably connected a special power track SPT. This special power track comprises a frequency converter FC that is electrically interposed between conventional track conductors CTC of conventional track lighting system CTLS and special track conductors STC, which are comprised within special power track SPT. Disconnectably connected with the special track conductors at different points therealong is a number of special track lighting units STLU1—STLUm. Special track lighting unit STLU1 comprises a 12 Volt Halogen lamp HL; which lamp is connected with and powered from the special track conductors STC by way of special step-down voltage transformer SVT.

Figures 4, 4A, 4B, 5, 6, 6A:
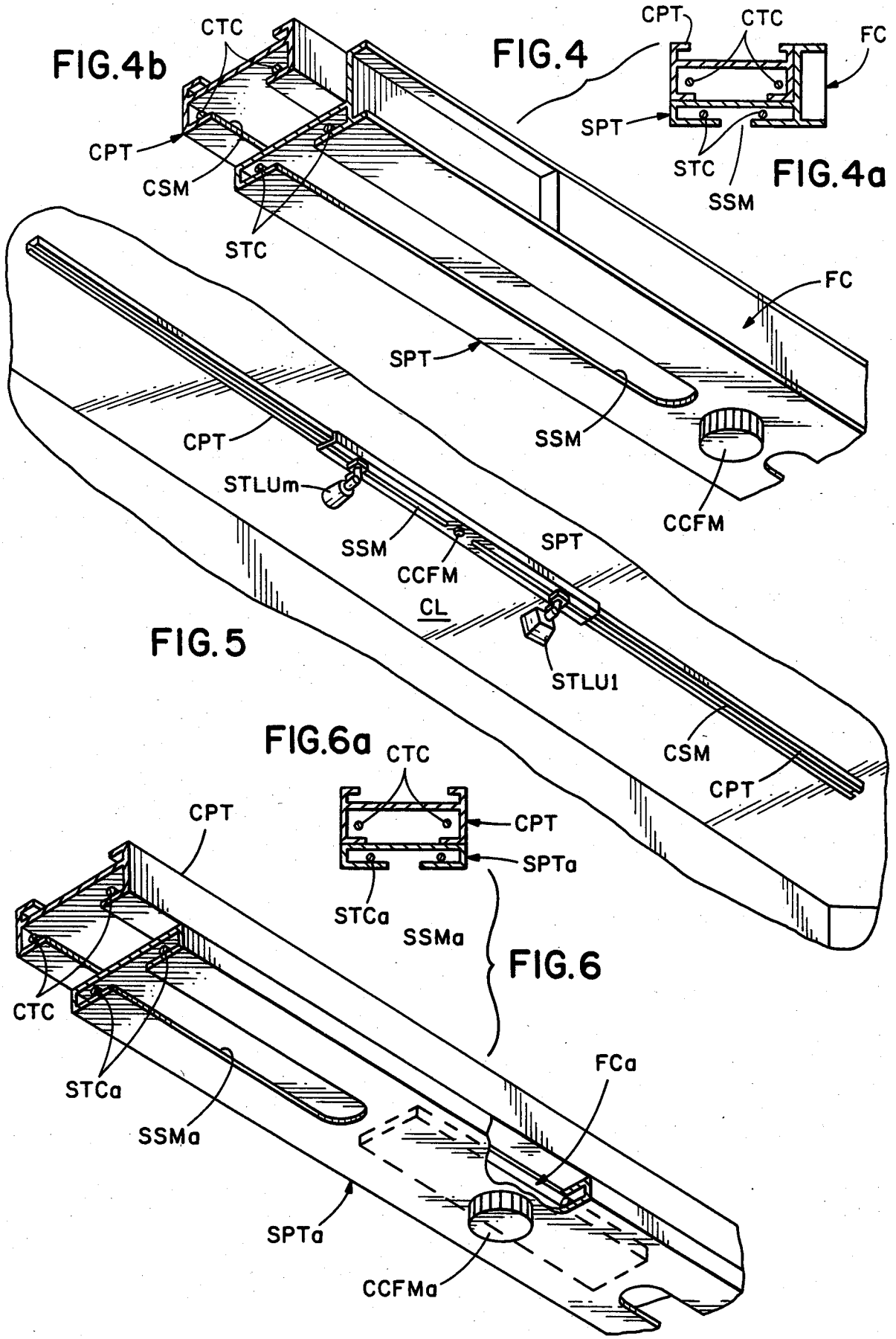

FIG. 4 illustrates the mechanical arrangement of the preferred embodiment: FIG. 4*a* being a cross-sectional view, and FIG. 4*b* being a perspective view.

CPT represents the conventional power track and CTC represents its two track conductors. Piggy-backed onto CPT, by way of substantially conventional power track connecting and fastening means CCFM, is the special power track SPT with its built-in frequency converter FC, special track conductors STC, and special slot means SSM.

FIG. 5 shows an installation on ceiling CL of the embodiment illustrated by FIGS. 3 and 4.

FIG. 6 illustrates an alternative mechanical layout suitable for implementing the circuit arrangement of FIG. 3: FIG. 6*a* being a cross-sectional view, and FIG. 6*b* being a perspective view.

In correspondence with FIG. 4, CPT represents the conventional power track and CTC represents its two track conductors. Piggy-backed onto CPT, by way of substantially conventional alternative power track connecting and fastening means CCFMa, is the alternative special power track SPTa with its built-in alternative frequency converter FCa, alternative special track conductors STCa, and alternative special slot means SSMa.

The operation of the preferred embodiment may be explained as follows.

In FIG. 3, by way of conventional connecting and fastening means CCFM, special power track SPT is disconnectably connected with conventional track conductors CTC of conventional power track CPT of conventional track lighting system CTLS; thereby providing 120 Volt/60 Hz voltage to frequency converter FC.

The frequency converter, which is preferably a full bridge transformer-less transistor inverter operating directly on non-filtered rectified 120 Volt/60 Hz voltage, provides to the special track conductors STC an output voltage of about 120 Volt/30 kHz.

Thus, the voltage applied to special track lighting units STLU1 and STLUm is 120 Volt/30 kHz; which implies that the special step-down voltage transformer SVT is very small in volume and weight in relationship to its power handling capabilities. For instance, for the 12 Volt/50 Watt Halogen lamp in STLU1, this special high-frequency transformer occupies less than one cubic inch of volume and weighs about one ounce.

Since the low-voltage Halogen lamps are also very modest in volume and weight, the special track lighting units can be designed to be compact and very modest in weight as compared with conventional track lighting units for low-voltage Halogen lamps, such as CTLUn, which has to contain a relatively bulky and heavy conventional voltage transformer, such as CVT.

As a consequence of the compactness and modest weight of the special track lighting units, as combined with the relatively modest size and weight of the frequency converter (which, since it is transformer-less and operates directly on non-filtered 120 Volt/60 Hz voltage, is indeed very compact and light of weight), the special power track SPT can be correspondingly compact and modest in weight.

In FIG. 4 is shown how the special power track SPT is piggy-backed onto conventional power track CPT. In conventional fashion, the conventional connecting and fastening means CCFM is used to provide for electrical connection between the track conductors in the conventional power track and the input to the frequency converter FC in the special power track. At the same time and in the same conventional fashion, CCFM is also used for mechanically fastening the special power track to the conventional power track.

The frequency converter is designed such as to be capable of providing enough high-frequency power to operate a number of special track lighting units, thereby permitting several such track lighting units to be used with the special power track.

In the arrangement of FIG. 4, the frequency converter is placed in a special side compartment of the special power track; which implies that the special slot means SSM can extend the full length of the special power track.

FIG. 5 illustrates an installation of a conventional track lighting system wherein, according to the present invention, a special power track is piggy-backed onto the conventional power track. For simplicity, only a single fastening means is shown, namely CCFM. However, it is anticipated that—especially for relatively long lengths of special power tracks—more than one such fastening means will be used.

FIG. 6 indicates an alternative version of a special power track. In this case, however, the frequency converter has been located directly in line with the special power track—in effect, such as to occupy part of the length of this special power track. In other words, with this arrangement, the special slot means can not extend quite the full length of the special power track.

In addition to the arrangements illustrated by FIGS. 3 to 6, the present invention anticipates and includes a number of different implementations and modifications, a few of which are described as follows.

(a) The special power track does not need to contain it own frequency converter. Rather, the frequency converter can readily be a separate entity suitable for direct plug-in connection with the conventional power track (or with any other suitable source)—with the special power track (sans frequency inverter) fastened onto the conventional power track and powered by plug-in connection with the separate frequency converter.

(b) The special power track can readily be provided with more than one pair of track conductors, thereby for instance permitting the cost-effective use therein of a wider variety of track lighting units.

(c) The special power track can readily be arranged to be placed on the side of the conventional power track, thereby permitting both tracks to be used for lighting purposes.

(d) The frequency converter may contain voltage transformer means, thereby making it possible to provide a voltage of any desired magnitude for the special track conductors. However, including such a transformer means makes it substantially non-feasible to provide the frequency converter as a compact built-in part of the special power track.

(e) The frequency converter may provide other functions in addition to and/or even instead of frequency conversion. In fact, in a broader sense, the frequency converter may be substituted with any kind of voltage conditioning means; which, for instance, could be a time-programmable switching and/or dimming means.

(f) In a still broader sense, the special power track may be thought of as a power conditioning and distributing means that is operable to plug into and to be supported by an ordinary power track of an ordinary track lighting system, and to provide for output means operative to receive, hold and power a plurality of special lighting units. And, of course, there is no need for this power conditioning and distributing means to be shaped as an ordinary power track. Rather, it could for instance be shaped as a shallow cylindrical structure—with receptacle means for special lighting units distributed along its periphery, and with the voltage conditioning means built into its central part.

It is believed that the present invention and its several attendant advantages and features will be understood from the preceeding description. However, without departing from the spirit of the invention, changes may be made in its form and in the construction and assembly of its constituent parts; the form herein presented merely representing its presently preferred embodiment.

I claim:

1. A power distributing means for use with a track lighting system, said track lighting system having a power track adapted for mounting onto a surface, said power track having a pair of track conductors and a receptacle slot operable to receive and hold a number of track lighting units, said track conductors being provided with power line voltage from an ordinary electric utility power line, said power distributing means comprising:

input terminals;

distributing conductor means;

voltage conditioning means connected in circuit between said input terminals and said distributing conductor means, said voltage conditioning means being operable to provide a conditioned voltage onto said distributing conductor means, said conditioned voltage being substantially different in frequency and/or magnitude as compared with said power line voltage;

receptacle means operable to receive and hold a plurality of special track lighting units, each of said special track lighting units being operable to connect with and to be properly powered from the conditioned voltage on said distributing conductor means; and structure means operative to mechanically support and hold together said input terminals, distributing conductor means, voltage conditioning means, and receptacle means, said structure means having connect means operable to provide disconnectable connection between said structure means and said power track, thereby providing for said power distributing means to be held in substantially rigid mechanical relationship to said power track as well as for said input terminals to make electrical contact with said track conductors.

2. The power distributing means of claim 1 wherein said voltage conditioning means comprises frequency conversion means.

3. The power distributing means of claim 1 wherein said conditioned voltage is of a frequency that is substantially higher than that of said power line voltage.

4. The power distributing means of claim 1 wherein said structure means comprises power track means.

5. The power distributing means of claim 4 wherein said power track means comprises said distributing conductor means.

6. A power distributing means for use with a track lighting system, said track lighting system having a power track adapted for mounting onto a surface, said power track having a pair of track conductors and a receptacle slot operable to receive and hold a number of track lighting units, said track conductors being provided with power line voltage from an ordinary electric utility power line, said power distributing means comprising:

voltage conditioning means operable to be powered from said power line voltage and to provide an output of conditioned voltage different from said power line voltage;

distributing conductor means operable to receive, hold and make contact with a plurality of track lighting units; and structure and connect means operable to: (i) hold said distributing conductor means in a substantially rigid mechanical relationship with said power track, and (ii) connect said voltage conditioning means in circuit between said track conductors and said distributing conductor means, thereby to provide said conditioned voltage to these distributing conductor means.

7. The power distributing means of claim 6 wherein said voltage conditioning means comprises frequency converter means.

8. The power distributing means of claim 6 wherein said conditioned voltage is an AC voltage of frequency substantially higher than that of said power line voltage.

9. The power distributing means of claim 6 wherein said structure and connect means comprises plug means operable to plug into said receptacle slot and be supported by said power track.

10. The power distributing means of claim 6 wherein said distributing conductor means is mechanically integrated with said structure and connect means.

11. The power distributing means of claim 10 wherein said structure and connect means comprises special power track means, said special power track means having special receptacle slot means and special track conductor means, said track conductor means being connected with said distributing conductor means, said receptacle slot means being operable to receive and hold a plurality of track lighting units.

12. A special power track for use with an ordinary track lighting system, said ordinary track lighting system having an ordinary power track adapted for mounting onto a surface, said ordinary power track having a pair of ordinary track conductors and an ordinary receptacle slot operable to receive and hold a number of ordinary track lighting units, said ordinary track conductors being provided with power line voltage from an ordinary electric utility power line, said special power track comprising:

input terminals;

special track conductors comprised within said special power track;

frequency converter connected in circuit between said input terminals and said special track conductors, said frequency converter being operable to provide an AC voltage onto said special track conductors, said AC voltage having a frequency substantially higher than that of said power line voltage;

special receptacle slot operable to receive and hold a number of special track lighting units, said special track lighting units being operable to connect with and to be properly powered from the AC voltage on said special track conductors; and connect means operable to provide disconnectable connection between said special power track and said ordinary power track, thereby providing for said special power track to be held in substantially rigid mechanical relationship to said ordinary power track as well as for said input terminals to make electrical contact with said ordinary track conductors.

13. A track lighting system comprising:

a first power track mounted on a surface and having a first pair of track conductors, said first power track being operable to receive, hold and connect with each of a first plurality of a first type of track lighting units, said first pair of track conductors being connected with an ordinary electric utility power line and carrying a first voltage that is substantially equal to the voltage on said power line;

a second power track having a second pair of track conductors and being operable to receive, hold and connect with each of a second plurality of a second type of track lighting units; and voltage conditioning means connected in circuit between said first pair of track conductors and said second pair of track conductors, and operable to cause said second pair of track conductors to carry a second voltage that is conditioned to be substantially different from said line voltage in at least one characteristic, such as frequency and/or magnitude;

whereby said first type of track lighting units may be used with said first power track and said second kind of track lighting units may be used with said second power track, the first kind of track lighting units being adapted to be properly powered by way of said first voltage, the second kind of track lighting units being adapted to be properly powered by way of said second voltage.

14. An arrangement comprising:

a first power track having a first pair of track conductors;

a second power track adapted to be mounted onto said first power track in piggy-back manner and having a second pair of track conductors; and voltage conditioning means connected between said first and said second pair of track conductors, and operable to receive a first voltage present at said first pair of track conductors and to provide a second voltage to said second pair of track conductors, said second voltage having frequency and/or magnitude substantially different as compared with said first voltage.

* * * * *